United States Patent [19]

Fogel

[11] 4,167,049

[45] Sep. 11, 1979

[54] WATERBED FRAME COVER

[75] Inventor: Isaac Fogel, Silver Spring, Md.

[73] Assignee: Classic Products Corporation, Beltsville, Md.

[21] Appl. No.: 880,471

[22] Filed: Feb. 23, 1978

[51] Int. Cl.[2] ..... A47C 27/08

[52] U.S. Cl. ..... 5/402; 5/484; 5/460

[58] Field of Search ..... 5/60, 334 R, 334 C, 5/339, 365-371

[56] References Cited

U.S. PATENT DOCUMENTS

| | | | |
|---|---|---|---|
| 3,742,531 | 7/1973 | Alabury et al. | 5/371 |
| 3,840,921 | 10/1974 | LaBianco | 5/370 |
| 4,015,299 | 4/1977 | Tinnel | 5/370 |
| 4,062,077 | 12/1977 | Autrey et al. | 5/367 |

*Primary Examiner*—Casmir A. Nunberg
*Attorney, Agent, or Firm*—Anne M. Kornbau

[57] ABSTRACT

A waterproof waterbed frame safety cover is disclosed which completely encloses a waterbed decking board and upstanding rails. The waterbed frame safety cover comprises top and bottom sheets welded together along one end, wherein the remaining two sides and end are open for inserting a waterbed frame. The top sheet of the safety cover is formed to match the cavity of a waterbed frame having inwardly inclined upstanding rails and a contoured bottom mattress. A waterproof zipper closure seals the waterbed frame in the safety liner.

5 Claims, 2 Drawing Figures

WATERBED FRAME COVER

BACKGROUND OF THE INVENTION

The present invention relates to a waterproof waterbed frame safety cover, and in particular, to a waterbed frame safety cover of improved construction which will hold the water contents of a waterbed mattress supported on the waterbed frame should the mattress leak.

It is well known that one of the major problems with waterbed installation is the danger of a water leak. The problem has become so publicized that many apartment building owners will not allow waterbeds above the first floor. Waterbed mattresses are usually well constructed and in most situations do not leak unless abused. On those rare occasions when a waterbed mattress does leak, it behooves a person who uses a waterbed to have some protective means for containing the water.

With the advent of waterbeds a new type of frame structure was developed to support a water-filled mattress. Generally, the most commonly used structure includes some type of platform or pedestal which supports a decking board. The decking board is surrounded by an upstanding frame structure that includes rails. A water-filled mattress is supported within the frame structure.

Another type waterbed frame structure is disclosed in my copending application titled "Waterbed Assembly" which has peripheral inclined walls and a recessed contoured foam mattress surface forming a cavity. The exterior of the frame is protected against water leaks by an outside cover and a liner. A water-filled mattress is positioned within the peripheral inclined walls of the frame construction. The peripheral inclined walls are adhesively secured to the peripheral top surface edge of a decking panel thereby forming a cavity or recess in which a plurality of foamed plastic mattress pads are also adhesively secured to the decking panel. The mattress pads have raised shelf areas where one of the shelves is to support a person's head and the other shelf is to support another person's head and where both shelves are slightly higher than the mattress pad or pads.

The waterbed frame is protected against waterbed leaks by an outside lower cover of waterproof vinyl plastic which is stretched over the decking panel and partially over the upstanding peripheral rails. An outside liner, made of a waterproof vinyl plastic, or the like, is stretched over the rails of the foamed plastic frame to overlap the upper edge of the outside lower cover, to form in cooperation with the lower cover a waterproof covering completely surrounding the foamed plastic mattress pads, the foamed plastic frame and the decking panel.

A water-filled mattress protected by a safety liner is placed in the cavity formed in the waterbed frame. The waterbed mattress safety liner which is the subject of my pending application Ser. No. 865,931, filed Dec. 30, 1977, has a top sheet and a bottom sheet joined by side walls. The top wall has a longitudinal opening which is closed by a zipper arrangement. The safety liner is made of a waterproof vinyl plastic and all seams are double welded to protect against possible leaks.

Kuss, U.S. Pat. No. 3,761,974, discloses a waterbed construction which includes a waterbed liner of a waterproof vinyl which fits between a waterbed mattress and a frame. The liner drapes down the interior walls of the frame and covers the decking board to contain possible water leaks. This type of liner is adequate for the box-like frame shown in the Kuss patent; however it does not provide protection should the liner tear. Also, the liner is not constructed to seal the interior and exterior of a contoured frame such as the frame disclosed in my copending application mentioned above.

Another waterbed frame which includes a platform or decking board surrounded by vertical walls forming a cavity for a waterbed mattress and vinyl liner which fits between the frame cavity and waterbed mattress, is shown in Tinnel, U.S. Pat. No. 4,015,299.

Labianco, U.S. Pat. No. 3,840,921, and Alsbury et al, U.S. Pat. No. 3,742,531, disclose waterbed constructions of molded foam plastic having inclined vertical peripheral walls and a recessed surface forming a cavity where the frame is covered by a vinyl cover. Labianco shows a cover which fits between the water-filled mattress and the frame and attaches to the bottom of the decking board. Alsbury et al show a waterproof cover which seals the waterbed mattress and frame together as a unit. Any water leaking out of the mattress which spills over the perimeter of the frame is contained within the cover.

While the prior constructions have met with success, they have not solved the problem of providing a waterproof cover which will contain the water from a waterbed mattress used with a contoured frame. The present invention provides a waterproof cover which completely seals the frame and conforms to the contoured structure of the frame. Should the mattress leak the cover of the present invention will contain the water even if a leak develops in the contoured area of the cover. No other waterproof cover has been constructed to provide two such margins of safety.

SUMMARY OF THE INVENTION

It is an object of this invention to provide a waterbed frame safety cover which completely encloses a waterbed frame.

It is another object of this invention to provide a waterbed safety cover which is simple to install on a waterbed frame.

It is still another object of this invention to provide a waterbed safety cover which will contain the water leaked from a waterbed mattress.

It is an object of this invention to provide a waterbed frame cover with a waterproof zipper closure whereby the zipper will seal against water leaks.

The waterbed frame cover of this invention includes a top sheet joined to a bottom sheet along one end and where the open sides and open end are sealed by a slidable closure against water leaks. The open sides and open end are formed with one-half on the top sheet and the other half on the bottom sheet. The end of the cover where the top sheet and bottom sheet are joined provides a hinge to open the cover when a waterbed frame is inserted. The top sheet is contoured to fit the contoured cavity of a waterbed which has inwardly inclined walls and a bottom section having a middle section lower than the end sections.

DESCRIPTION OF THE PREFERRED EMBODIMENT

Figure 1:
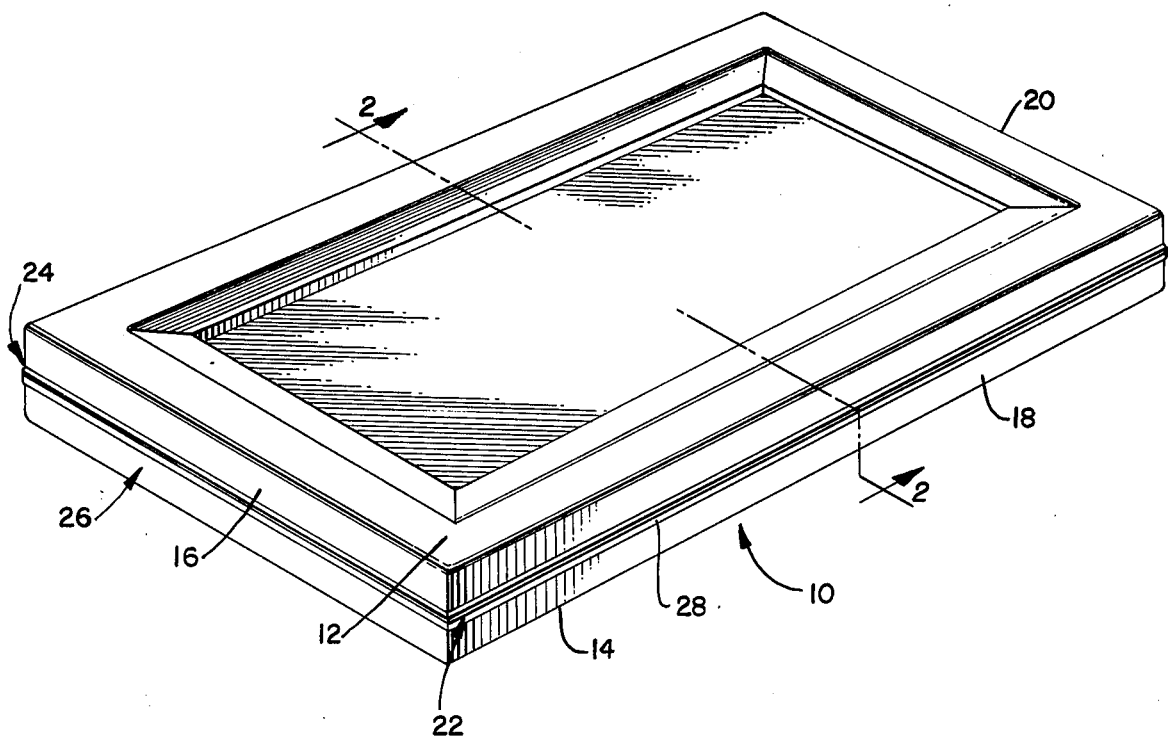
FIG. 1 shows a perspective view of the waterbed frame cover of this invention.

Referring to the drawings and with particular reference to FIG. 1 there is shown a waterbed frame cover 10 of the present invention. As shown, the cover 10 is made in two halves; a top sheet 12 and a bottom sheet 14 which are welded together along one end. The bottom sheet 14 has side walls 16 and end walls 18; only one end wall is shown. Top sheet 12 has side walls 20 and end walls 22; one shown. The top sheet 12 is permanently joined to the bottom sheet 14, for example, by heat welding an end wall 22 to an end wall 18; this connection is not shown. The connection between the top sheet 12 and the bottom sheet 14 forms a hinge for folding the top sheet 12 out of the way when a waterbed frame is placed in the cover. The side walls 16 and end wall 18 of bottom sheet 14 and the side walls 20 and end wall 22 of top sheet 12 form an opening which is closed by a slide zipper 24. The zipper 24 has tongue and groove closure elements 26 and 28 which create a water tight seal. The zipper has two halves which are attached, as by heat welding, in the opening formed by the top side and end walls and the bottom side and end walls.

Figure 2:
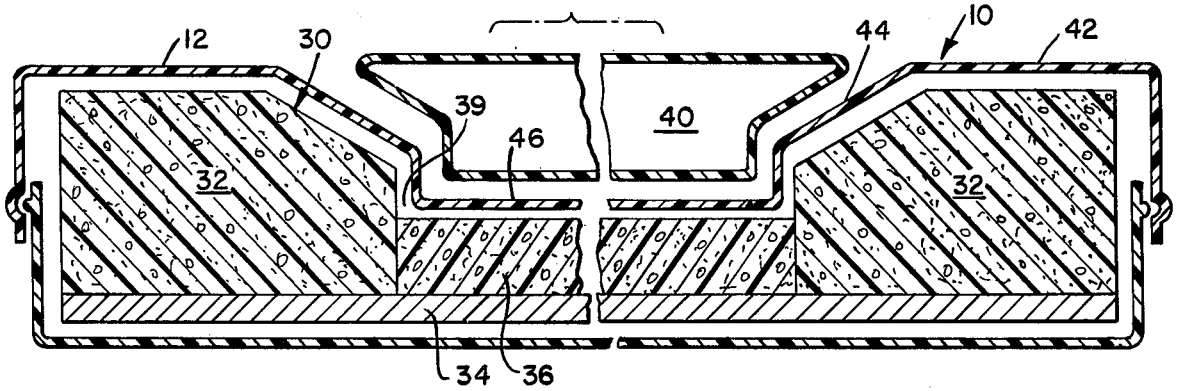
FIG. 2 is a cross sectional view of the waterbed frame cover of this invention taken along the line 2—2 of FIG. 1.

FIG. 2 shows a waterbed frame 30 which includes upstanding peripheral walls 32 bonded to a decking board 34 and a contoured foam mattress pad 36. The peripheral walls 32 have inwardly inclined wall surfaces 38 which absorb water wave action from a water-filled mattress 40. The combination of the walls 32 and mattress pad 36 form a cavity 39 in the frame 30. The waterbed frame construction is self supporting in that decking board 34 is a rigid or semi-rigid material, such as wood, composition board or corrugated cardboard and the upstanding peripheral walls are of a dense synthetic plastic foam. The assembled waterbed, with a cover 10, is placed on a pedestal designed for waterbeds without the use of any fasteners because the frame is self supporting.

The top sheet 12 has a flat horizontal top surface 42, inwardly inclined surfaces 44, and a bottom surface 46. The contours of top sheet 12 are constructed to fit in the cavity 39 of the waterbed frame 30. The mattress pad 36 of frame 30 may also be contoured, to have a lower middle section and raised shelf section. If the mattress pad 36 is contoured, the bottom section 46 of the top sheet is also contoured to match the mattress pad 36.

The waterbed frame 30 is placed on bottom sheet 14 by folding the top sheet 12 of the cover along end 20. Once the waterbed frame 30 is in place, the top sheet 12 is brought into position to fit the contour of the waterbed frame 30 and the cover 10 is sealed by closing zipper closure 24. The cover 10 closely fits the waterbed frame to provide an attractive appearance and to eliminate folds which might tear.

Another feature of the waterbed frame cover 10 is that it prevents the waterbed frame 10 foam rails 32 from bowing outward. This is because of the close fit of the cover 10 and the weight of the waterbed mattress 40 which stretches the cover to exert an inwardly directed force on the rails and the rail corners. Even though the rails are firmly bonded to the decking board, there may be unforeseen situations where a rail or corner might pull loose. On those occasions the inward force of the closely fitting cover 10 will support the rail.

Synthetic plastic foams will deteriorate if exposed to light and air. Prior foam plastic waterbed frames have been subject to such deterioration since most frames were not covered. The cover 10 of this invention prevents this type of deterioration since the frame is protected from light and air.

Occasionally, mildew has been a problem with the foam plastic of the prior waterbed frames. The cover 10 of this invention protects the foam plastic from any dampness which would cause mildew. If a heater is installed inbetween the waterbed frame and cover 10, the temperature of the water in the mattress is kept at or above the ambient temperature and, therefore, prevents condensation inside the cover, which is another cause of mildew. The heater, which is not shown, would be installed in cavity 39.

The cover 10 is made of a heavy duty vinyl plastic such as 20 mil or of some other waterproof plastic material.

Although only one specific embodiment of the waterbed frame cover has been described and illustrated in the drawings, it will be understood that various modifications and changes may be made by those skilled in the art without departing from the inventive concept. Reference should therefore be made to the appended claims for a definition of the scope of the invention.

What is claimed is:

1. A waterbed frame cover of waterproof vinyl plastic for covering a waterbed frame which includes a decking board, upstanding peripheral sides bonded to the decking board and a mattress pad bonded to the decking board, where the decking board, the peripheral sides and mattress pad form a contoured cavity surface for supporting a water-filled mattress, comprising:

a bottom waterproof plastic sheet, which covers the outside surface of the decking board of the waterbed frame, a top waterproof plastic sheet which covers the contoured cavity surface of the waterbed frame, said bottom sheet and said top sheet having matching side walls and end walls, said bottom sheet being joined at one end along a matching end wall, a closure extending around said side walls and the other of said end walls to seal said waterbed frame cover.

2. A waterbed frame cover as claimed in claim 1 wherein said top sheet includes inwardly inclined walls and a horizontal surface to match the contoured cavity surface of a waterbed frame.

3. A waterbed frame cover as claimed in claim 2 wherein said top sheet and said bottom sheet are of a waterproof vinyl plastic of 20 mil thickness.

4. A waterbed frame cover as claimed in claim 3 wherein said closure is a zipper means.

5. A waterbed frame cover as claimed in claim 4 wherein said zipper closure is of a heavy duty molded plastic with tongue and groove closure elements where the zipper closure is heat sealed to said top sheet and to said bottom sheet.

* * * * *